US005114820A

United States Patent [19]

Georges et al.

[11] Patent Number: 5,114,820

[45] Date of Patent: May 19, 1992

[54] POLYALKYL STYRENE BUTADIENE TONER COMPOSITIONS

[75] Inventors: Michael K. Georges, Guelph; Lupu Alexandru, Toronto, both of Canada

[73] Assignee: Xerox Corporation, Stamford, Conn.

[21] Appl. No.: 428,134

[22] Filed: Oct. 27, 1989

[51] Int. Cl.[5] ..... G03G 9/00

[52] U.S. Cl. ..... 430/109; 430/904

[58] Field of Search ..... 430/109, 110, 107, 111, 430/137, 904

[56] References Cited

U.S. PATENT DOCUMENTS

| | | | |
|---|---|---|---|
| 3,853,778 | 12/1974 | Buckley et al. | 252/62.1 |
| 3,980,576 | 9/1976 | Vijayendran | 252/62.1 P |
| 4,231,922 | 11/1980 | Robeson | 525/64 X |
| 4,299,898 | 11/1981 | Williams et al. | 430/106 |
| 4,311,779 | 1/1982 | Miyakawa et al. | 430/107 |
| 4,469,770 | 9/1984 | Nelson | 430/110 |
| 4,533,614 | 8/1985 | Fukumoto et al. | 430/99 |
| 4,558,108 | 12/1985 | Alexandru et al. | 526/340 |
| 4,572,885 | 2/1986 | Sato et al. | 430/109 X |
| 4,770,968 | 9/1988 | Georges et al. | 430/108 |
| 4,828,955 | 5/1989 | Kasai et al. | 430/111 |
| 4,853,311 | 8/1989 | Tavernier et al. | 430/109 X |
| 4,937,166 | 6/1990 | Creatura et al. | 430/108 |
| 4,954,412 | 9/1990 | Breton et al. | 430/137 |
| 5,035,970 | 7/1991 | Hsieh et al. | 430/109 |

*Primary Examiner*—Marion E. McCamish
*Assistant Examiner*—Stephen Crossan
*Attorney, Agent, or Firm*—E. O. Palazzo

[57] ABSTRACT

A toner composition comprised of pigment particles and a branched polyalkyl/styrene/butadiene copolymer of the following formula

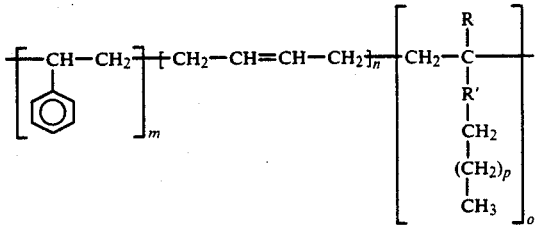

wherein m, n and o are weight fraction numbers, p represents the number of $CH_2$ groups, R is hydrogen or alkyl, and R′ is carbonyloxy or aryl.

28 Claims, No Drawings

POLYALKYL STYRENE BUTADIENE TONER COMPOSITIONS

BACKGROUND OF THE INVENTION

This invention is generally directed to resin compositions useful as toner and developer composition components. More specifically, the present invention relates to polyalkyl, especially branched polyalkyl, styrene butadiene resins such as acrylate styrene butadiene ternary copolymers useful for the formulation of toner compositions that can be selected for a number of imaging processes including those wherein silicone release oils are avoided. In one embodiment, there are provided in accordance with the present invention branched polyalkyl styrene/butadiene ternary copolymer resins that can be selected for the formulation of low melting, for example about 255° F. to about 300° F. in some embodiments, toner compositions containing, for example, pigment particles, and optional additive particles. In addition, the present invention is directed to processes for the preparation of the aforementioned resins by suspension free radical polymerization processes with short reaction times, and wherein products of high purity and high yields can be obtained. Processes for the preparation of the aforementioned polymers using free radical procedures can be accomplished by the emulsion polymerization techniques as illustrated in U.S. Pat. No. 4,469,770, and suspension polymerization processes as illustrated in U.S. Pat. No. 4,558,108, the disclosures of each of these patents being totally incorporated herein by reference. The low melting toner and developer compositions formulated with the branched polyalkyl resins illustrated herein are particularly useful in electrophotographic imaging and printing methods especially methods wherein soft roll fusers are selected. Further, the polyalkyl branched polymers of the present invention can be selected as emulsifiers to enable, for example, complete effective mixing of toner components such as blends of toner resins and release agents. In a specific embodiment of the present invention, there are provided low melting toners thereby enabling, for example, the advantage of decreased energy output from, for example, fuser rollers present in electrophotographic imaging and printing apparatuses enabling longer lifetime for such rollers. Moreover, by selecting lower fusing roll temperatures, there results decreased silicone oil volatility in situations wherein a silicone oil is employed thus less silicone oil is consumed and associated problems therewith are minimized and/or eliminated. The toners of the present invention in a number of embodiments possess a minimum fusing temperature of from about 255° F. to about 275° F., which temperature is effective and desirable for accomplishing the aforementioned advantages and other advantages.

A patentability search report cited the following prior art, all U.S. patents: U.S. Pat. No. 4,311,779 which discloses one component magnetic developers with certain binder components, reference for example columns 5 and 6 of this patent, and further note column 11, working Example 4, beginning at around line 50, and more specifically 55, wherein there was selected a thermoplastic resin vinyl toluene 2-ethylhexyl acrylate butadiene terpolymer; U.S. Pat. No. 3,853,778 directed to electrostatographic toners wherein the resin can be comprised of styrene and an alkyl methacrylate wherein the alkyl contains 14 carbon atoms or more, which polymers are sharp melting and exhibit rapid changes in melt viscosity, see column 4, and moreover, note column 4, line 50, wherein any suitable particulate resin having an amorphous backbone and side chain crystallinity imparted by C14 or longer alkyl group, a sharp melting point in the range of 40° C. to 145° C. and the other characteristics may be selected; and as background interest U.S. Pat. No. 3,980,576 directed to toner compositions with a resinous binder comprising a combination of thermoplastic resins based on a copolymer of styrene and an acrylate or methacrylate, which copolymer is combined with vinyl toluene butadiene, and wherein the developer particles have a melting index of 20 to 30 and a melting point of 75° to 100° C., reference the Abstract of the Disclosure, for example; U.S. Pat. No. 4,299,898 disclosing powder charged toners containing quaternary ammonium salts attached to acrylic polymers, reference for example the Abstract of the Disclosure; and U.S. Pat. No. 4,533,614 disclosing heat fixable dry toners wherein the binder resin comprises a nonlinear modified low melting polyester, reference the Abstract of the Disclosure, for example, and also note columns 7 and 8.

Toner and developer compositions, especially those containing charge enhancing additives, are well known, reference for example U.S. Pat. Nos. 3,893,935; 3,944,493; 4,007,293; 4,079,014 and 4,394,430. Thus, for example, there is described in U.S. Pat. No. 3,893,935 the selection of certain lower alkyl quaternary ammonium salts $R_4N+X-$ as charge control agents for electrostatic toner compositions. Further, there are disclosed in U.S. Pat. No. 4,338,390 developer and toner compositions having incorporated therein as charge enhancing additives organic sulfate and sulfonate substances. A similar disclosure is present in U.S. Pat. No. 4,394,430. Moreover, there are disclosed in U.S. Pat. No. 4,298,672, the disclosure of which is totally incorporated herein by reference, positively charged toner compositions with resin particles and pigment particles; and as a charge enhancing additive, alkyl pyridinium compounds, inclusive of cetyl pyridinium chloride.

Additionally, toner and developer compositions useful in xerographic imaging processes wherein silicone oils are not needed are known, reference for example U.S. Pat. No. 4,556,624, the disclosure of which is totally incorporated herein by reference. In this patent, there are disclosed improved positively charged toner compositions comprised of a polyblend mixture of crosslinked copolymer compositions, a second polymer, pigment particles, and a particular wax component thereby enabling the toner compositions to be selected for imaging systems wherein release fluids can be eliminated. The types of resin described in this patent and other patents relating to toner compositions, including those compositions useful in imaging methods wherein release fluids are avoided include polyamides, epoxies, diolefins, polyurethanes, vinyl resins and polymeric esterification products of a dicarboxylic acid, and a diol comprising a diphenol. Typical monomers selected for the preparation of the appropriate aforementioned resins include styrene, p-chlorostyrene, unsaturated monoolefins such as ethylene, propylene, butylene, isobutylene and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and other similar acrylates; acrylonitrile, methacrylonitrile, and acrylimide; vinyl ethers such as vinyl methyl ether, vinyl isobutyl ether, vinyl ethyl ether, and the like; vinyl ketones such as vinyl methyl ketone, vinyl hexyl ketone, and methyl isopropenyl ketone, and N-vinyl indole, N-vinyl pyrrolidene, and the like; styrene butadiene copolymers, and mixtures thereof.

As preferred toner resins illustrated in the '624 patent, there can be selected styrene polymers, and the esterification products of a dicarboxylic acid, and a diol comprising a diphenol. The aforementioned polyesters are illustrated in U.S. Pat. No. 3,590,000, the disclosure of which is totally incorporated herein by reference. Other specific preferred toner resins include styrene/methacrylate copolymers; styrene/butadiene copolymers; polyester resins obtained from the reaction of bisphenol A and propylene oxide; followed by the reaction of the resulting product with fumaric acid; branched polyester resins resulting from the reaction of dimethylterephthalate, 1,3-butanediol, 1,2-propanediol, and pentaerythritol; styrene butadiene copolymers prepared by a suspension polymerization process, reference U.S. Pat. No. 4,558,108, the disclosure of which is totally incorporated herein by reference; styrene butadiene resins prepared by an emulsion polymerization process, reference U.S. Pat. No. 4,469,770, the disclosure of which is totally incorporated herein by reference; and Pliolites.

Furthermore, illustrated in U.S. Pat. No. 3,418,354 are processes for obtaining olefin-polyoxyalkylene copolymers by a graft reaction with a peroxide, whereby there are generated free radical sites on the backbone polymer. One process embodiment disclosed in the '354 patent involves the addition of an alpha olefin, such as styrene, and a peroxide to a polyoxyalkylene compound, such as a siloxane, wherein there results a graft copolymer; and more specifically, an olefin-polyoxyalkylene graft copolymer, see column 2, line 23. In Japanese Patent Publication 46-9355, there is disclosed a process for the preparation of graft block copolymers with a polysiloxane chain by the reaction of a functional polysiloxane with a polymer obtained from the anion polymerization of a styrene or a butadiene. Japanese Patent Publication 58-225103 discloses a method for the crosslinking of a thermoplastic resin by the reaction of a hydrogenated styrene-butadiene-styrene block copolymer with a silane in the presence of organic peroxides. Further, in U.S. Pat. No. 3,691,257 there are disclosed organic polymers modified by incorporating therein a siloxane polymer organic block copolymer; while Japanese Patent Publication 57-187345 describes a rubber modified styrene resin prepared by continuous bulk polymerizations in the presence of organic polysiloxanes and 1,2-vinyl polymers.

In U.S. Pat. No. 4,770,968, the disclosure of which is totally incorporated herein by reference, there are illustrated toner compositions with polysiloxane styrene butadiene copolymers of the formulas recited, for example, in the specification and Claim 1, which toners can be selected, for example, in xerographic imaging processes wherein no silicone release fluids are needed.

There is a need for low melting toners and for simple economical processes that enable the preparation of branched polyalkyl/styrene/butadiene resins in high yields exceeding 80 percent, for example, and wherein the resulting products are of an acceptable purity exceeding in most instances 98 percent. There is also a need for low melting, that is toners that have minimum fix temperatures of from about 255° F. to about 300° F. In addition, there is a need for toner resins that permit the formulation of toner compositions that possess desirable mechanical properties, excellent fusing characteristics, and acceptable release properties. Moreover, there is a need for developer compositions containing toner components, including the branched polyalkyl/styrene/butadiene copolymers illustrated herein, and carrier components. There is also a need for imaging and printing methods wherein there are selected toner and developer compositions containing the branched polyalkyl/styrene/butadiene copolymers disclosed herein. Moreover, there remains a need for low melting toner compositions that are compatible with fusing rolls incorporated into imaging apparatuses, especially Viton fuser rolls, and which compositions require less energy for fixing, for example, a temperature of about 25° F. lower can be selected for melting the toner in some embodiments of the present invention compared to 25° F. higher for conventional toners such as those containing styrene methacrylate, or styrene butadiene copolymer resins in place of the polyalkyl styrene butadiene copolymers of the present invention.

With further respect to the invention of the present application, particularly the developer compositions thereof, one Viton soft fuser roll selected for use in electrophotographic copying machines is comprised of a soft roll fabricated from lead oxide and DuPont Viton E-430 resin, a vinylidene fluoride hexafluoropropylene copolymer. This roll contains approximately 15 parts of lead oxide and 100 parts of Viton E-430, which mixture is blended and cured on the roll substrate at elevated temperatures. Apparently, the function of the lead oxide is to control the generation of unsaturation by dehydrofluorination which can cause crosslinking, and to provide release mechanisms for the toner composition.

SUMMARY OF THE INVENTION

It is an object of the present invention to provide toner compositions with many of the advantages illustrated herein.

In another object of the present invention there are provided toner compositions comprised of branched polyalkyl/styrene/butadiene resins.

In still a further object of the present invention there are provided economical processes for the preparation of polyalkyl/styrene/butadiene resin compositions.

Another object of the present invention resides in the provision of low melting toner compositions with polyalkyl/styrene/butadiene resins, which toners can be fused with reduced fusing energy.

Further, in another object of the present invention there are provided branched polyalkyl/styrene/butadiene toner compositions that possess excellent fusing and release characteristics.

In a further object of the present invention there are provided specific toner compositions and processes which are compatible with Viton fuser rolls.

These and other objects of the present invention are accomplished by providing toner and developer compositions. More specifically, there are provided in accordance with the present invention toner compositions comprised of branched polyalkyl styrene butadiene polymers. The present invention is directed in one embodiment to toner compositions comprised of branched polyalkyl/styrene/butadiene polymers, especially copolymers of the following formula

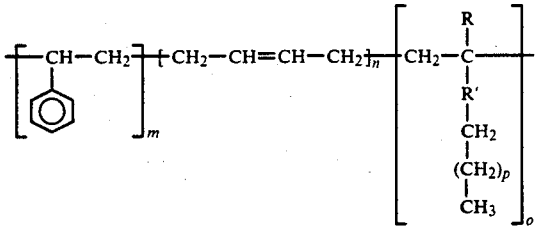

wherein m, n and o are weight fraction numbers with m being preferably from about 0.35 to about 0.95, n being preferably from about 0.1 to about 0.2, and o preferably being from about 0.02 to about 0.4; p represents the number of $CH_2$ groups and is preferably from about 6 to about 100; R is a proton (hydrogen), an alkyl group with, for example, from 1 to about 6 carbon atoms such as methyl, ethyl, propyl, butyl, pentyl, and the like; and R' is carbonyloxy such as [—CCO)O—], aryl with, for example, from 6 to about 24 carbon atoms, such as phenyl, and the like.

Examples of polyalkyls (the $CH_2$ repeating units p) selected for the polymers of the present invention include n-octyl acrylate, n-decyl acrylate, n-lauryl methacrylate, n-octadecyl methacrylate, n-octadecyl acrylate, isodecyl methacrylate, methacrylate terminated polymeric Unilin alcohols, reference U.S. Pat. No. 4,883,736, the disclosure of which is totally incorporated herein by reference, 2,3 or 4-alkyl styrene derivatives prepared from chloromethyl styrene, including for example, 1,4-n-lauryl styrene, and the like.

Examples of preferred branched polyalkyl styrene butadiene copolymers include poly(styrene-co-butadiene-b-n-laurylmethacrylate) wherein m is 0.85, n is 0.10, o is 0.05, and p is 10, which copolymer has a glass transition temperature of 56° C. and a melt index of 44 grams per minute; poly(styrene-co-butadiene-b-n-laurylmethacrylate) wherein m is 0.83, n is 0.12, o is 0.05 and p is 10, which copolymer has a glass transition temperature of 50.3° C. and a melt index of 47.5 grams per 10 minutes; poly(styrene-co-butadiene-b-n-octadecylmethacrylate) wherein m is 0.85, n is 0.10, o is 0.05 and p is 16, which copolymer has a glass transition temperature of 48° C.; and poly(styrene-co-butadiene-b-n-octadecylmethacrylate) wherein m is 0.83, n is 0.07, o is 0.10 and p is 16, which copolymer has a glass transition temperature of 46° C.

The polyalkyl/styrene/butadiene copolymers can be generally prepared by suspension free radical polymerization processes or emulsion polymerizations. More specifically, in one embodiment these resins can be prepared by the reaction of styrene, preferably with a weight fraction amount of from about 0.35 to about 0.95, 1,3-butadiene, preferably with a weight fraction amount of from about 0.1 to about 0.2, and n-lauryl methacrylate, preferably with a weight fraction amount of from about 0.05 to about 0.4, in the presence of Alkanol, tricalcium phosphate, benzoyl peroxide, and 0,0-t-butyl-0-(2-ethylhexyl)monoperoxycarbonate. The reaction is usually conducted by heating at an effective temperature, preferably at 95° C. for 3.5 hours, followed by heating to 125° C. over a period of 40 minutes, and maintaining the reaction mixture at 125° C. for 1 hour. After cooling, the desired product is washed with concentrated nitric acid, filtered and rinsed with water. Subsequently, the polyalkyl/styrene/butadiene product is dried overnight at 40° C. under a vacuum. The products were characterized by 80 MHz $^1H$ NMR, melt index, glass transition, softening temperature, and GPC. Also, the products can be obtained in yields of from 95 percent to 98 percent with a purity as determined by percent ash residue of greater than 99 percent, and preferably 99.9 percent.

More specifically, the branched polyalkyl/styrene/-butadiene copolymers of the present invention can be prepared in accordance with the following reaction scheme wherein m is 0.85, n is 0.10, o is 0.05, and p is 11, R is methyl, and R' is carbonyloxy.

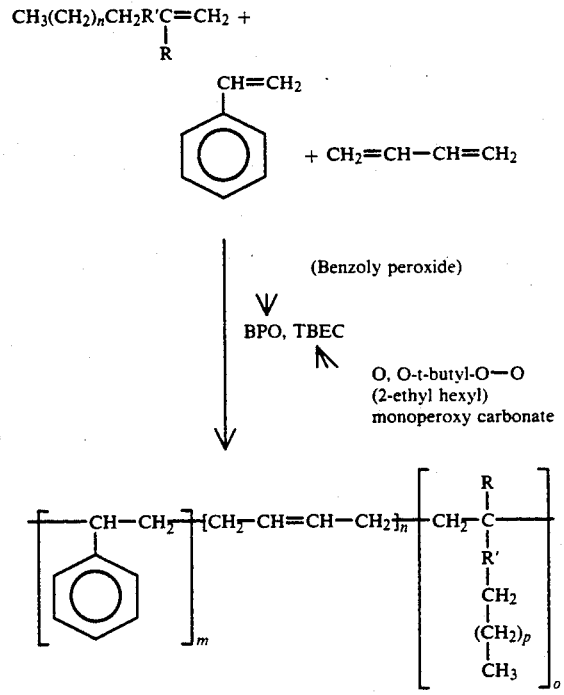

In another process embodiment, there was prepared polystyrene-co-butadiene branched n-lauryl methacrylate wherein styrene (weight fraction from about 0.35 to about 0.95), butadiene (weight fraction from about 0.1 to about 0.2, n-lauryl methacrylate (weight fraction from about 0.02 to about 0.4), benzoyl peroxide (2.0 to 3.0 grams per mole of monomers), and O,O-t-butyl-O-(2-ethylhexy) monoperoxycarbonate (0.30 to 0.40 milliliter per mole of monomers) are added to a suspension of tricalcium phosphate (about 3 grams to about 6 grams per mole of monomer) in deionized water (100 milliliters) containing Alkanol (from about 0.03 gram to about 0.08 gram per mole of monomer) heated to 95° C. The reaction is performed in an inert atmosphere of nitrogen and is allowed to continue for about 3 to 3.5 hours. The reaction mixture is then heated to 125° C. over a period of 40 minutes, maintained at 125° C. for about 1 hour and then cooled to room temperature. Nitric acid, about 4 milliliters to about 10 milliliters is then added, followed by stirring the reaction mixture for about 10 minutes. The resulting aqueous phase is removed by filtration and the product is rinsed with approximately 1.5 liters of deionized water. The desired n-lauryl methacrylate product was dried overnight (18 hours) under vacuum at 40° and 44° C., and characterized by GPC, which product had an $M_n$ of from about 13,000 to about 22,000 and an $M_w$ of from about 50,000 to about 250,000, a glass transition temperature was from about 40° C. to about 60° C., and an MI, melt index of from about 35 grams/10 minutes to greater than 50 grams/10 minutes. Also, $^1H$ NMR was selected to determine the presence and relative amounts of each monomer.

The aforementioned illustrated branched polymers can be formulated into toner compositions, including colored toner compositions, by for example admixing therewith pigment particles such as carbon black, magnetites, cyan, magenta, yellow, red, green, blue, or mixtures thereof, and the like in an effective amount of, for example, from about 1 to about 20 percent by weight. Numerous well known suitable pigments or dyes can be selected as the colorant for the toner including, for example, carbon black, nigrosine dye, aniline blue, magnetites, and mixtures thereof. The pigment, which is preferably carbon black, should be present in a sufficient amount to render the toner composition highly colored thus enabling the formation of a clearly visible image on a suitable recording member. Generally, the pigment particles are present in amounts of from about 1 percent by weight to about 20 percent by weight based on the total weight of the toner composition, however, lesser or greater amounts of pigment components can be selected. Magnetites are usually present in an amount of from about 10 to about 75 percent by weight. The branched polymers are present in the toner in various effective amounts, including for example from about 70 to about 99 weight percent, and preferably from about 85 to about 95 percent by weight, however, other amounts can be selected. The total amount of all toner components should equal about 100 percent.

In addition, as indicated herein the pigment particles can also be selected from cyan, magnenta, yellow, blue, red, green, and other similar colored pigments, or mixtures thereof enabling the formation of colored developer compositions. These pigments are generally present in the toner compositions in an amount of from about 2 percent by weight to about 30 percent by weight. Illustrative examples of cyan, magenta and yellow pigments that can be selected include, for example, 2,9-dimethyl-substituted quinacridone, and anthraquinone dye identified in the Color Index as CI 60710, CI Dispersed Red 15; a diazo dye identified in the Color Index as CI 26050, CI Solvent Red 19; and the like. Illustrative examples of cyan materials that may be used as pigments include copper tetra-4-(octadecyl sulfonamido) phthalocyanine; X-copper phthalocyanine pigment listed in the Color Index as CI 74160, CI Pigment Blue; and Anthrathrene Blue, identified in the Color Index as CI 69810; Special Blue X-2137; and the like; while illustrative examples of yellow pigments that may be selected include diarylide yellow 3,3-dichlorobenzidene acetoacetanilides, a monoazo pigment identified in the Color Index as CI 12700, CI Solvent Yellow 16; a nitrophenyl amine sulfonamide identified in the Color Index as Foron Yellow SE/GLN; CI Dispersed Yellow 33, 2,5-dimethoxy-4-sulfonanilide phenylazo-4'-chloro-2,5-dimethoxy acetoacetanilide; Permanent Yellow FGL; red, green, brown, blue, Lithol Scarlet, and other similar compositions.

Illustrative examples of carrier particles that can be selected for mixing with the toner of the present invention, thus enabling developer compositions, include those particles that are capable of triboelectrically obtaining a charge of opposite polarity to that of the toner particles. Accordingly, the carrier particles of the present invention can be selected to be of a negative polarity allowing the toner particles which are positively charged to adhere to and surround the carrier particles. Specific examples of carrier particles include steel, nickel, iron ferrites, including copper zinc ferrites, and the like. Additionally, there can be selected as carrier particles nickel berry carriers as disclosed in U.S. Pat. No. 3,847,604, the disclosure of which is totally incorporated herein by reference, which carriers are comprised of nodular carrier beads of nickel characterized by surfaces of reoccurring recesses and protrusions thereby providing particles with a relatively large external area. The selected carrier particles can be used with or without a coating, the coating generally being comprised of fluoropolymers, such as polyvinylidene fluoride resins, terpolymers of styrene, methylmethacrylate, and a silane, such as vinyl triethoxysilane, tetrafluoroethylenes, copolymers available as FP 461, reference U.S. Ser. No. 751,922/85 (now abandoned) the disclosure of which is totally incorporated herein by reference, two polymer coatings such as a mixture of Kynar/polymethylmethacrylate, reference U.S. Pat. No. 4,937,166 and U.S. Pat. No. 4,935,326 the disclosures of which are totally incorporated herein by reference; other known coatings, and the like. The polymer coating weight is dependent on a number of factors; generally, however, from about 0.1 to about 4 percent by weight of coating is present.

The diameter of the carrier particles, which can vary, is generally from about 50 microns to about 1,000 microns, thus allowing these particles to possess sufficient density and inertia to avoid adherence to the electrostatic images during the development process. The carrier particles can be mixed with the toner composition in various suitable combinations, however, best results are obtained when about 1 part to about 10 parts toner to about 200 parts by weight of carrier are combined, although other admixtures can be selected.

The toner compositions of the present invention can be prepared by a number of known methods including melt blending the toner resin particles containing the pigment particles followed by mechanical attrition, and classification primarily to remove undesirable toner particles with a size diameter, for example, of 0.5 microns or less, and 30 microns or more in some embodiments. Other methods include those well known in the art such spray drying, melt dispersion, dispersion polymerizations, suspension polymerizations, and extrusion processes. In one specific embodiment, toners are prepared by the extrusion of the polyalkyl/styrene/butadiene branched copolymer with an effective amount such as 6 percent Regal 330® carbon black at between 130° and 150° C. with a CSI laboratory extruder. The exiting extrudates were ground up and jetted using a Trost Gem T Jet Mill. The resultant toners were then treated with 5 weight percent of a 1 to 1 mixture of the charge additive, TP-302 (available from Hodogaya), or another charge additive, and Aerosil R972 with a coffee grinder. A carrier (60 grams) comprised of Kynar (polyvinylidene fluoride) and polymethylmethacrylate coated ferrite core was roll-milled with 2 grams of the aforementioned surface treated toner powders to form a xerographic developer with a tribo between 5 and 20 microcoulombs per gram for the toner and a toner concentration near 3 percent as determined by the well known Faraday cage blow off apparatus.

The toner and developer compositions of the present invention may be selected for developing images in electrophotographic imaging systems containing therein conventional photoreceptors, such as selenium, and selenium alloys, including selenium arsenic, selenium tellurium, other binary alloys, ternary alloys, and quaternary alloys. Illustrative examples of layered photoresponsive devices which can be selected include those comprised of transport layers and photogenerating layers, reference U.S. Pat. No. 4,265,990, the disclosure of which is totally incorporated herein by reference. Examples of generating layers include trigonal selenium, metal phthalocyanines, metal free phthalocyanines, squaraine pigments and vanadyl phthalocyanines, while examples of charge transport layers include the aryl amines as disclosed in U.S. Pat. No. 4,265,990. With layered imaging members, especially negatively charged members, there are usually included in the toner compositions charge enhancing additives such as alkyl pyridinium halides, organic sulfates, distearyl dimethyl ammonium methyl sulfate, and the like, reference the U.S. patents mentioned herein, the disclosures of which are totally incorporated herein by reference.

Furthermore, the toner compositions of the present invention can contain, preferably as external additives, colloidal silicas, metal salts of fatty acids, and metal salts, such as zinc stearate, which additives are usually present in an amount of from about 0.1 to about 5 percent by weight; reference U.S. Pat. Nos. 3,983,045 and 3,900,588, the disclosures of which are totally incorporated herein by reference.

The following examples are being supplied to further define various species of the present invention, it being noted that these examples are intended to illustrate and not to limit the scope of the present invention. Parts and percentages are by weight unless otherwise indicated.

Fusing evaluations were accomplished with a Model D xerographic test fixture and a 5028 silicone roll fuser equipped with an Omega pyrometer to determine fuser set temperature. Minimum fix level was determined at the temperature where fused images were resistant to eraser and fingernail abrasion, and by a tape test.

EXAMPLE 1

Synthesis of an n-Lauryl Methacrylate Branched Styrene/Butadiene Copolymer, wherein m=0.85, n=0.10, o=0.05 and p=10

Water (70 milliliters) was added to a modified mini-Parr reactor, and the reactor was then closed and heated. When the temperature reached 35° C., a slurry of tricalcium phosphate (4.0 grams) in a solution of Alkanol (48 milligrams) in water (30 milliliters) was added to the reactor. The temperature was allowed to increase to 95° C. over a period of 45 minutes while the reaction vessel was flushed with nitrogen gas. A solution of styrene (70.1 grams), butadiene (7.8 grams), n-lauryl methacrylate (4.0 grams), benzoyl peroxide (2.10 grams) and TBEC (0.27 milliliters) were added under pressure over a period of 16 minutes resulting in a final pressure, in the reaction vessel, of approximately 60 psi. The reaction was allowed to proceed at 95° C. for 3.5 hours, heated to 125° C. over 40 minutes, held at 125° C. for 1 hour and then cooled to room temperature. Concentrated nitric acid (8 milliliters) was then added and the mixture was stirred for 10 minutes. The above desired branched polymer product was filtered off, washed with water (~1500 milliliters) and dried overnight (18 hours) at 40° C. under a vacuum. Yield of the branched styrene-butadiene copolymer product was 97 percent. Tg (glass transition) was 56° C. and Ml (melt index) was 44 grams/10 minutes for this copolymer product. $M_n$ for this product copolymer was 18,000 and the $M_w$ was 68,770 as determined by GPC.

EXAMPLE II

Synthesis of an n-Lauryl Methacrylate Branched Styrene/Butadiene Copolymer, wherein m=0.83, n=0.12, o=0.05 and p=10

When the procedure of Example I was repeated with the following exceptions: 67.9 grams of styrene, 10.1 grams of butadiene, 3.9 grams of n-lauryl methacrylate, 2.15 grams of benzoyl peroxide, 0.27 milliliter of TBEC, 48 milligrams of Alkanol and 4.0 grams of tricalcium phosphate, in 100 milliliters of deionized water, the above n-lauryl methacrylate branched styrene/butadiene copolymer was obtained that had a Tg of 50° C. and a melt index of 47.5 grams/10 minutes. $M_n$ for this product copolymer was 17,928 and the $M_w$ was 92,965 as determined by GPC.

EXAMPLE III

Synthesis of Octadecyl Methacrylate Branched Styrene/Butadiene Copolymer, wherein m=0.85, n=0.10, o=0.05 and p=16

When the procedure of Example I was repeated with the following exceptions: 70.1 grams of styrene, 7.8 grams of butadiene, 4.1 grams of octadecylmethacrylate, 2.08 grams of benzoyl peroxide, 4.0 grams of tricalcium phosphate, 40 milligrams of Alkanol and 0.27 milliliter of TBEC in 100 milliliters of deionized water, the above octadecyl methacrylate branched styrene/-butadiene copolymer was obtained that had a Tg of 59° C., and a melt index of 44.3 grams/10 minutes. $M_n$ for this product copolymer was 18,826 and the $M_w$ was 72,259 as determined by GPC.

EXAMPLE IV

Synthesis of an Octadecyl Methacrylate Branched Styrene/Butadiene Copolymer, wherein m=0.83, n=0.07, o=0.10 and p=16.

When the procedure of Example I was repeated with the following exceptions: 67.9 grams of styrene, 5.9 grams of butadiene, 8.2 grams of octadecyl methacrylate, 1.98 grams of benzoyl peroxide, 48 milligrams of Alkanol, 4.0 grams of tricalcium phosphate and 0.27 milliliter of TBEC in 100 milliliters of deionized water, the above octadecyl methacrylate branched styrene/-butadiene copolymer was obtained with a Tg of 46° C.

Toner compositions were prepared by admixing the polyalkyl branched styrene/butadiene copolymer obtained from the process of Example I, 89 percent by weight, with 6 percent by weight of carbon black particles, and 5 percent by weight of a 1 to 1 mixture of the charge control additive TP-302 available from Hodogaya, and Aerosil R972, a flow additive. The aforementioned toner composition, 3 parts by weight, was then admixed with carrier particles, 100 parts by weight, comprised of a core of a copper zinc ferrite with a coating thereover of Kynar, 60 weight percent, (polyvinylidene fluoride) and poly(methyl methacrylate), 40 weight percent, 0.6 weight percent coating weight. This developer was then selected for incorporation into a xerographic Model D imaging apparatus test fixture, and a 5028 silicone roll fuser equipped with an Omega pyrometer to determine fuser set temperature.

The aforementioned toner had a measured blocking temperature of 125° F., a minimum fix temperature of 290° F. (as compared to a control of 330° F.), a hot offset temperature of about 370° F. and a triboelectric charge thereon of 20 microcoulombs per gram as determined in the known Faraday Cage apparatus.

The aforementioned control was a toner comprised of the above components and prepared in the same manner with the exception that there was selected as the copolymer in place of the polyalkyl branched styrene butadiene copolymer, a styrene butadiene, 89/11, and this toner had a minimum fix temperature of 330° F. as indicated.

Although the invention has been described with reference to specific preferred embodiments, it is not intended to be limited thereto, rather those skilled in the art will recognize variations and modifications may be made therein which are within the spirit of the present invention and within the scope of the following claims.

What is claimed is:

1. A toner composition comprised of pigment particles and a branched lauryl methacrylate/styrene/-butadiene polymer of the following formula

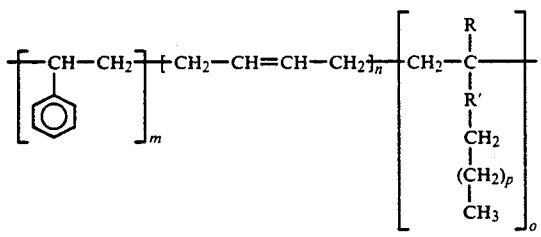

wherein m, n and o are weight fraction numbers, p is 10, R is methyl, and R′ is carbonyloxy, wherein the weight average molecular weight of said polymer is from 50,000 to less than 75,000, and minimum fix temperature of the toner is from about 225° F. to 300° F.

2. A toner composition in accordance with claim 1 wherein m is about 0.85, n is about 0.10, o is about 0.05.

3. A toner composition in accordance with claim 1 wherein m is about 0.83, n is about 0.12, o is about 0.05.

4. A toner composition in accordance with claim 1 wherein the pigment particles are selected from the group consisting of carbon black, magnetites and mixtures thereof.

5. A toner composition in accordance with claim 1 wherein the pigment particles are selected from the group consisting of cyan, magenta, yellow, red, blue, green, and mixtures thereof.

6. A toner composition in accordance with claim 1 wherein the pigment particles are present in an amount of from about 1 percent by weight to about 20 percent by weight.

7. A toner composition in accordance with claim 1 wherein the pigment particles are comprised of magnetite present in an amount of from about 10 percent by weight to about 70 percent by weight.

8. A toner composition in accordance with claim 1 containing colloidal silica additive particles.

9. A toner composition in accordance with claim 1 containing metal salts or metal salts of a fatty acid as additive particles.

10. A toner composition in accordance with claim 1 containing charge enhancing additives.

11. A toner composition in accordance with claim 10 wherein the charge enhancing additive is selected from the group consisting of alkyl pyridinium halides, distearyl dimethyl ammonium methyl sulfate, and organic sulfate or sulfonate compositions.

12. A toner composition in accordance with claim 11 wherein the charge enhancing additive is present in an amount of from about 0.1 to about 10 weight percent.

13. A developer composition comprised of the toner of claim 1 and carrier particles.

14. A developer composition in accordance with claim 13 wherein the carrier particles contain a polymer coating thereover.

15. A developer composition in accordance with claim 14 wherein the coating is present in an amount of from about 0.1 to about 6 weight percent.

16. A developer composition in accordance with claim 14 wherein the polymer is selected from the group consisting of fluorinated polymers, polymethyl methacrylates, and styrene methyl triethoxy silane terpolymers.

17. A developer composition in accordance with claim 14 wherein the polymer coating is comprised of a first polymer and a second polymer not in close proximity in the triboelectric series.

18. A developer composition in accordance with claim 17 wherein the first polymer is present in an amount of from about 10 to about 90 percent by weight, and the second polymer is present in an amount of from about 90 to about 10 weight percent.

19. A developer composition in accordance with claim 17 wherein the first polymer is a polyvinylidene fluoride and the second polymer is a polymethacrylate.

20. A developer composition in accordance with claim 13 wherein the carrier particles are comprised of a core selected from the group consisting of steel, iron, and ferrites.

21. A toner composition in accordance with claim 1 containing a low molecular weight wax.

22. A toner composition in accordance with claim 21 wherein the molecular weight of the wax is about 1,000 to about 6,000.

23. A toner composition in accordance with claim 21 wherein the low molecular weight wax is selected from the group consisting of polypropylene and polyethylene.

24. A method of imaging which comprises the formation of an electrostatic latent image on an imaging member, followed by development of this image with the toner composition of claim 1, subsequently transferring this image to a suitable substrate, and thereafter permanently affixing the image thereto.

25. A method of imaging in accordance with claim 24 wherein fixing is accomplished in the absence of a release fluid.

26. A toner composition in accordance with claim 1 wherein m is from about 0.35 to about 0.95.

27. A toner composition in accordance with claim 1 wherein n is from about 0.1 to about 0.2.

28. A toner composition in accordance with claim 1 wherein o is from about 0.02 to about 0.4.

* * * * *